US010227981B2

(12) United States Patent
Kanaizumi

(10) Patent No.: US 10,227,981 B2
(45) Date of Patent: Mar. 12, 2019

(54) PACKAGE TYPE FLUID MACHINE

(71) Applicant: Hitachi Industrial Equipment Systems Co., Ltd., Chiyoda-ku, Tokyo (JP)

(72) Inventor: Atsushi Kanaizumi, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 240 days.

(21) Appl. No.: 14/149,926

(22) Filed: Jan. 8, 2014

(65) Prior Publication Data

US 2014/0314586 A1 Oct. 23, 2014

(30) Foreign Application Priority Data

Apr. 19, 2013 (JP) ..... 2013-087972

(51) Int. Cl.

| | |
|---|---|
| ***F04C 23/00*** | (2006.01) |
| ***F01C 21/00*** | (2006.01) |
| ***F04C 18/02*** | (2006.01) |
| ***F04B 39/12*** | (2006.01) |
| ***F04B 39/14*** | (2006.01) |
| *F04C 29/12* | (2006.01) |
| *F04C 29/04* | (2006.01) |

(52) U.S. Cl.

CPC ..... *F04C 23/001* (2013.01); *F01C 21/007* (2013.01); *F04B 39/12* (2013.01); *F04B 39/121* (2013.01); *F04B 39/14* (2013.01); *F04C 18/0207* (2013.01); *F04C 29/04* (2013.01); *F04C 29/12* (2013.01)

(58) Field of Classification Search

CPC .... F04B 41/06; F04C 23/001; F04C 18/0207; F24F 7/00

USPC ..... 454/241–245, 250, 253

See application file for complete search history.

(56) References Cited

U.S. PATENT DOCUMENTS 5,584,678 A * 12/1996 Hirooka ..... F04C 27/005 418/142

7,461,483 B2 * 12/2008 Struthers ..... H04R 1/021 52/204.1

2005/0063844 A1 3/2005 Sato et al.

(Continued)

FOREIGN PATENT DOCUMENTS

JP 2005-98147 A 4/2005

OTHER PUBLICATIONS

Powerex SE Series Enclosed Scroll Air Compressor System Manual, May 2011, Powerex—150 Production Dr.—Harrison, OH 45030, Retrieved from http://www.powerexinc.com/images/PWX/documents/MANUALS/590400_0511_WEB.PDF on Dec. 10, 2015.*

(Continued)

*Primary Examiner* — Kenneth J Hansen

(74) *Attorney, Agent, or Firm* — Crowell & Moring LLP

(57) ABSTRACT

A package type fluid machine having a plurality of fluid machine units each of which includes a fluid machine, a motor that drives the fluid machine, and a belt that connects the fluid machine and the motor. The plurality of fluid machine units are arranged in a cabinet, wherein the plurality of fluid machine units has a pair of the fluid machine units, arranged opposed to each other, with the belts of the fluid machine units facing inward.

7 Claims, 9 Drawing Sheets

(56) References Cited

U.S. PATENT DOCUMENTS

2013/0092345 A1* 4/2013 McKie ..... F24F 12/001
165/7

OTHER PUBLICATIONS

Powerex Pure Air Technology, pp. 1-20, May 18, 2011, Harrison, Ohio, www.powerexinc.com.†

* cited by examiner
† cited by third party

PACKAGE TYPE FLUID MACHINE

INCORPORATION BY REFERENCE

The present application claims priority from Japanese patent application JP-2013-087972 filed on Apr. 19, 2013, the contents of which are hereby incorporated by reference into this application.

BACKGROUND OF THE INVENTION

The present invention relates to a package type fluid machine.

The related art in the technical field of the present invention is described in JP-A-2005-98147 or US patent application publication No. 2005/0063844.

In JP-A-2005-98147 or US patent application publication No. 2005/0063844, a package type fluidic apparatus is described. This package type fluidic apparatus has two (left and right) housings with an air intake passage between them and each of the housings has a plurality of chambers. In each of the chambers, a drive source and a fluid machine constitute a fluid machine unit.

SUMMARY OF THE INVENTION

The package type fluid machine described in JP-A-2005-98147 or US patent application publication No. 2005/0063844 is arranged in such a way that the pulley and the belt of one of the fluid machine units face outward. In a fluid machine, the parts that require maintenance (for example, the suction filter of a fluid machine) are usually arranged on the side opposite to the side on which the rotating objects, such as the pulley and the belt connecting the fluid machine and the driving source, are arranged with safety in mind. For this reason, the parts of the above-described fluid machine unit that require maintenance are arranged inside (on the intake passage side). Therefore, the fluid machine unit described in JP-A-2005-98147 or US patent application publication No. 2005/0063844 requires maintenance space between the two fluid machine units, requires a larger installation area, and makes it difficult to reduce the total size of the product.

In view of the foregoing, it is an object of the present invention to provide a package type fluid machine that requires a smaller installation area.

To solve the problem described above, the present invention provides a package type fluid machine that includes a plurality of fluid machine units each of which includes a fluid machine, a motor that drives the fluid machine, and a belt that transmits the power of the motor to the fluid machine. The plurality of fluid machine units are arranged in a cabinet, wherein the plurality of fluid machine units has a pair of the fluid machine units, arranged opposed to each other, with the belts of the fluid machine units facing inward.

According to the present invention, a package type fluid machine, which requires a smaller installation area, is provided.

Other objects, features and advantages of the invention will become apparent from the following description of the embodiments of the invention taken in conjunction with the accompanying drawings.

DESCRIPTION OF THE EMBODIMENTS

First Embodiment

A first embodiment of the present invention is described with reference to FIGS. 1 to 5. The present invention relates to a fluid machine, which includes a compressor of scroll type or other types, a vacuum pump, an expander, and a blower. More particularly, the present invention relates to a package type fluid machine that contains a combination of a fluid machine and a driving device (motor) in the cabinet (package). In this embodiment, a package type compressor, in which a scroll type compressor and a motor are arranged in the cabinet, is used as an example.

In this embodiment, the scroll type compressor includes a fixed scroll 18 and a orbiting scroll 19 that is driven by the motor. In the example described below, the orbiting scroll 19, arranged opposed to the fixed scroll 18, performs the rotating movement to compress air.

Figure 1:
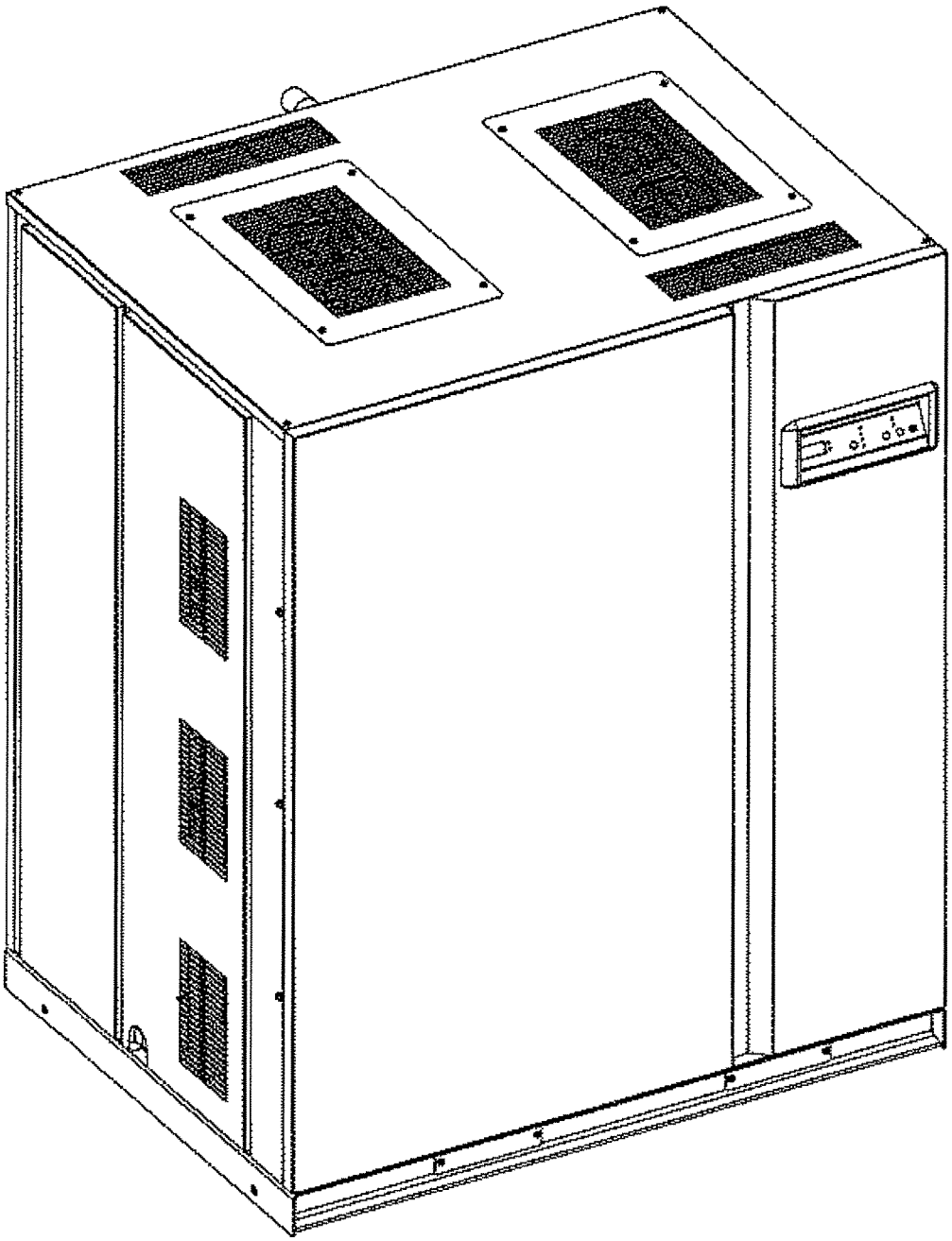
FIG. 1 is a diagram showing the structure of a package type compressor in a first embodiment of the present invention.
Figure 2:
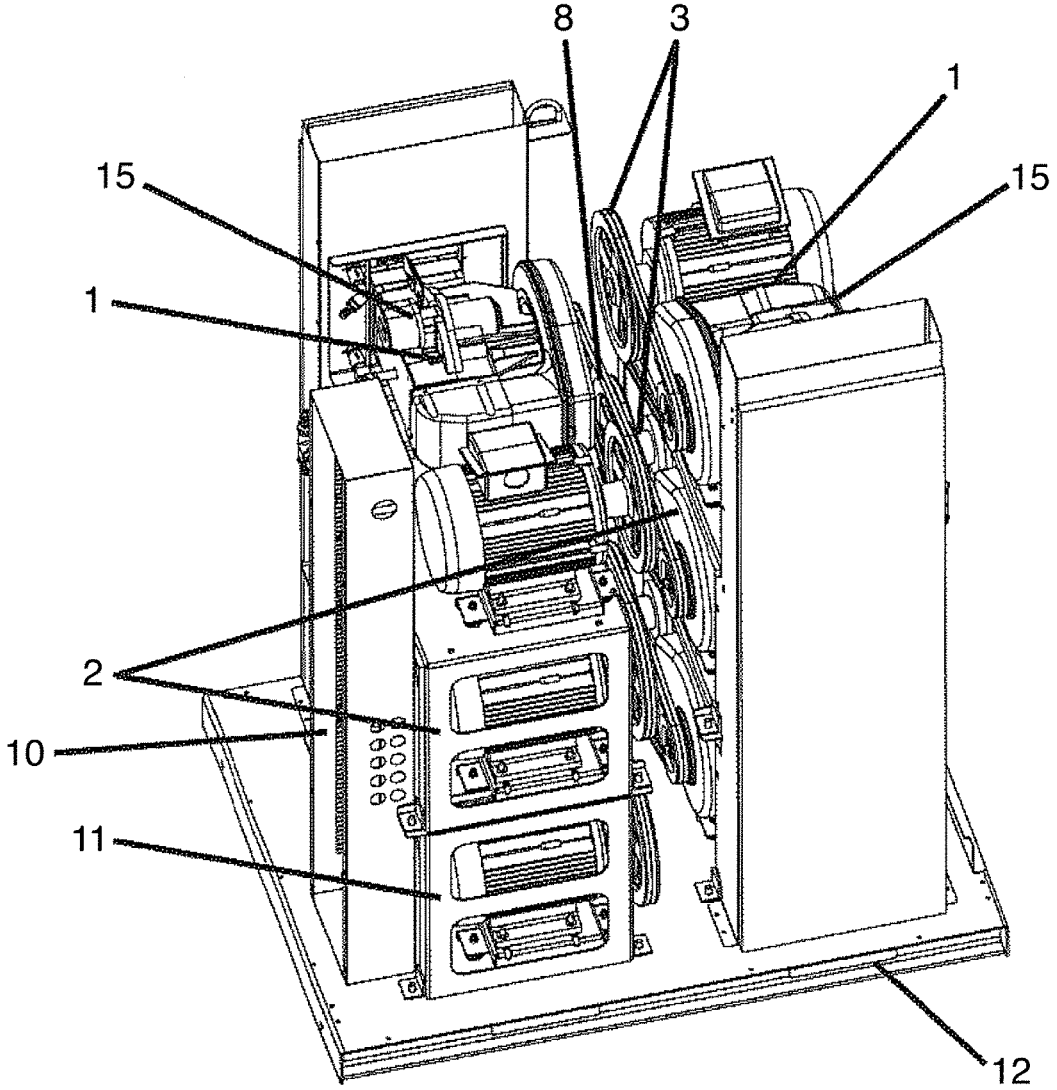
FIG. 2 is a diagram showing the structure inside the cabinet of the package type compressor in the first embodiment of the present invention.

A package type compressor in this embodiment is described below with reference to FIG. 1 and FIG. 2. FIG. 1 is a diagram showing the package type compressor in this embodiment as viewed from outside the cabinet. FIG. 2 is a diagram showing the structure of the inside of the cabinet shown in FIG. 1. In this embodiment, a plurality of compressor (fluid machine) units 1 is stacked in each of stacking units 2 using a frame 11, and those stacking units 2 are arranged opposed to each other on a base 12 via a rubber vibration insulator 10, which reduces the vibration of the compressor unit 1, with a pulley 3 and a belt 8 facing inward. That is, at least two compressor units 1 in this embodiment are arranged opposed to each other with the pulley 3 and the belt 8 facing inward, and a pair of opposed compressor units 1 are arranged in several stacks. Although the stacking unit 2, in which a pair of compressor units 1 are stacked in several stacks, is used as an example in this embodiment, a pair of compressor units 1 need not always be stacked but may be arranged in a single stack.

Figure 3:
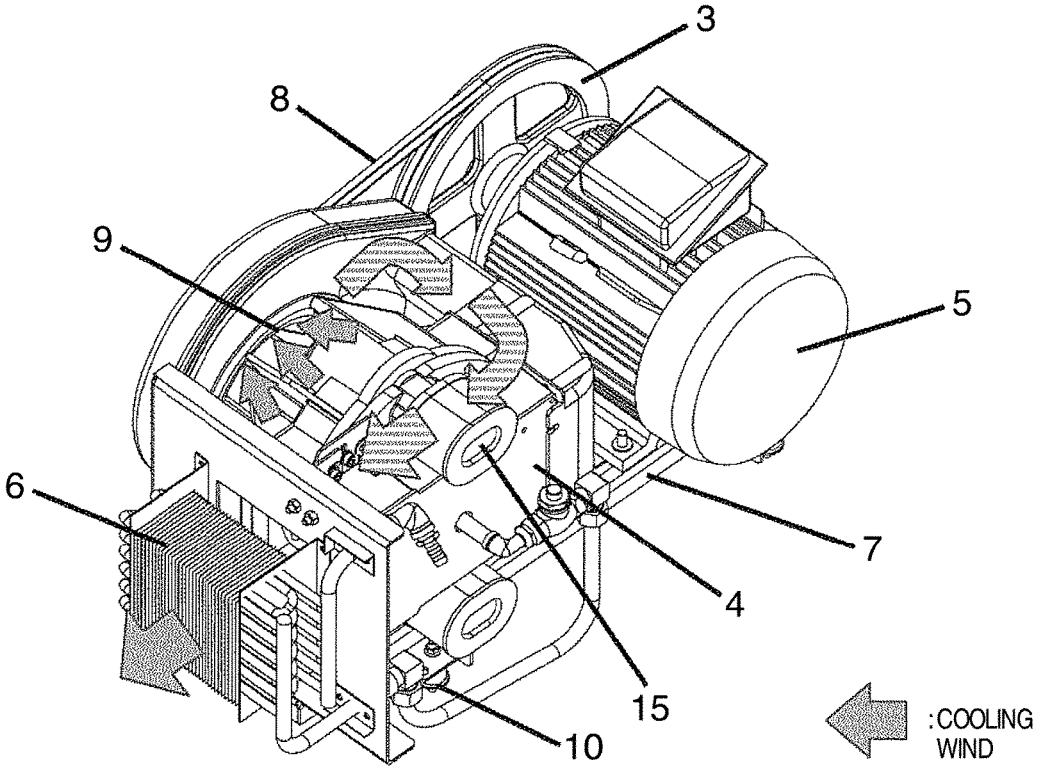
FIG. 3 is a diagram showing a compressor unit in the first embodiment of the present invention.

The configuration of the compressor unit 1 is described with reference to FIG. 3. The compressor unit 1, which includes a compressor (fluid machine) main body 4, a motor 5, and an after cooler 6, is arranged on a compressor base 7. The compressor main body 4 is driven by transmitting the power of the motor 5 to the compressor main body 4 via the pulleys 3, provided on the motor 5 and the compressor main body 4, and the belt 8 that connects the pulleys 3. When the compressor main body 4 is driven by the motor 5 via the pulleys 3 and the belt 8, air is taken in from the outside via a suction filter 15 and the air is compressed.

Figure 4:
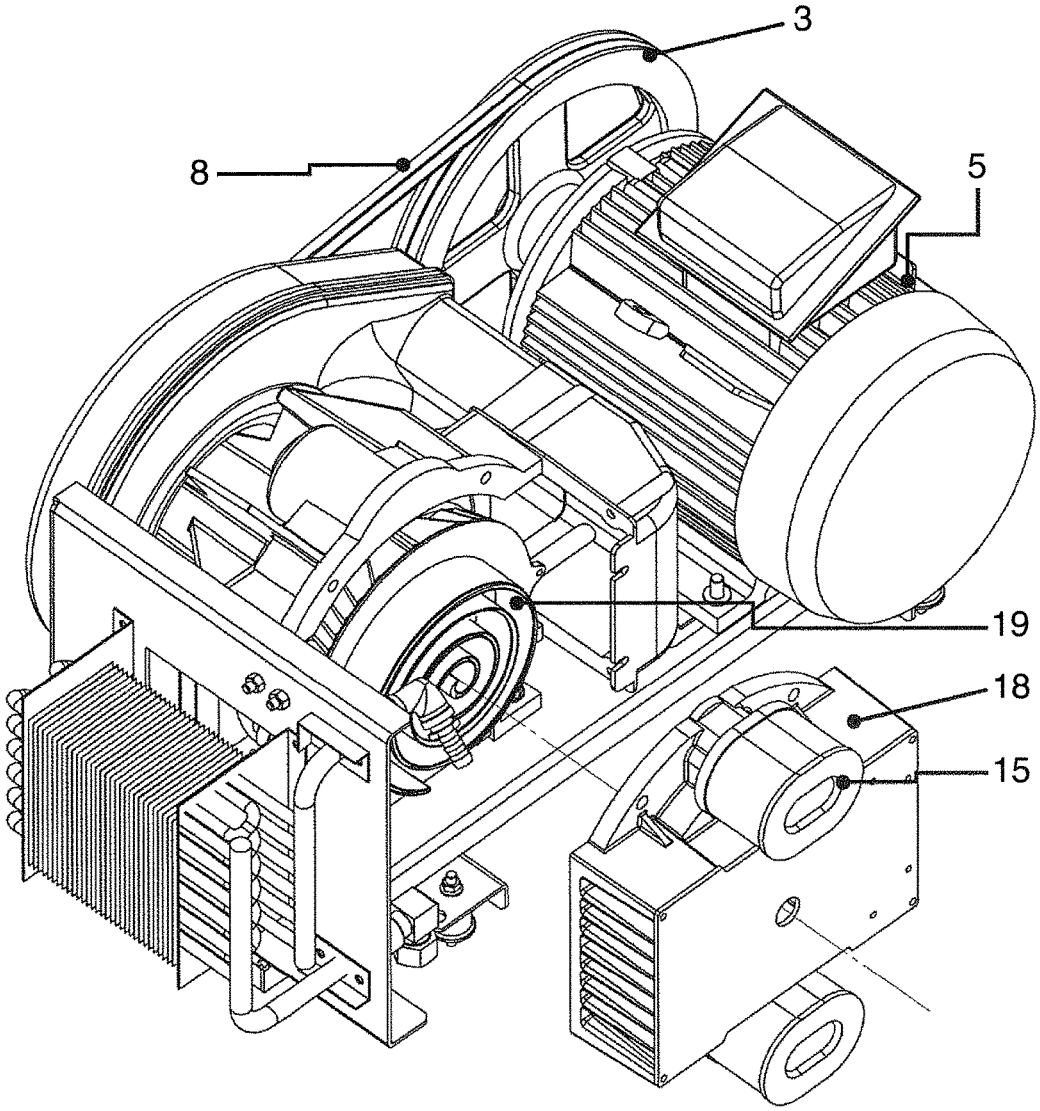
FIG. 4 is a diagram showing the compressor unit in the first embodiment of the present invention from which a fixed scroll is removed.

Because the compressor main body 4 sucks in air from outside via the suction filter 15, it is necessary to prevent the suction filter 15 from being clogged with dust. This means that the suction filter requires frequent maintenance. In addition, the inside of the scroll (inside of the compressor main body 4) requires regular maintenance such as the replacement of the seal member and the replenishment of grease. As shown in FIG. 4, the fixed scroll 18 must be removed to maintain the inside of the scroll. Therefore, the maintenance of the suction filter 15 and the compressor main body 4 requires a large space.

On the other hand, when making a belt tension adjustment for the pulley 3 and the belt 8, only the minimum distance for measuring the center distance between the compressor main body 4 and the motor 5 is required and, therefore, a large space is not necessary for adjusting the belt tension (for example, about 100 mm). The pulley 3 usually stops during maintenance, but may turn by drive of the compressor main body 4 with the motor 5. Therefore, in consideration of safety, the pulley 3 is arranged in a place away from the maintenance required parts such as the compressor main body 4 (especially, fixed scroll 18 that must be removed) or the suction filter 15.

Considering the configuration described above, a pair of compressor units 1 is arranged in this embodiment in such a way that the compressor units 1 are opposed to each other so that the maintenance required parts, such as the compressor main body 4 (especially the fixed scroll 18 that must be removed) and the suction filter 15, face outward and the pulleys 3 and the belt 8 face inward as shown in FIG. 2. This configuration allows the maintenance required parts, such as the fixed scroll 18 (inside of compressor main body 4) and the suction filter 15, to be accessed easily from the right or left direction of the cabinet, making it possible to easily clean the suction filter 15 or to remove the fixed scroll.

In addition, because the belt tension adjustment work does not need a large space, the distance between the stacking unit 2 is made smaller. This structure can reduce the installation area of the base 12 and reduce the total size of the product.

Although a scroll type compressor has been described as an embodiment of the invention, it is also required to clean the suction filter of a reciprocating compressor and a screw type compressor and to maintain the inside of the main body of a reciprocating compressor and the main body of a screw type compressor. That is, also for a reciprocating compressor and a screw type compressor, the pulleys 3 and the belt 8 are arranged inside and the maintenance required compressor main body 4 and suction filter 15 are arranged on the outer side of the pulley 3 and the belt 8 as in the scroll type compressor.

The cooling of an area near the compressor main body 4 in this embodiment is described with reference to FIG. 3.

The compressor main body 4 generates high-temperature heat of compression when compressing air. In addition, the compressor main body 4 and the motor 5 generate heat during the operation and this generated heat increases the temperature inside the cabinet. The high temperature in the cabinet may cause a deterioration of a reliability of the compressor main body 4, the motor 5, or other components. Therefore, it is necessary to ventilate the inside of the cabinet efficiently for cooling the compressor main body 4 and the motor 5.

To address this problem, a sirocco fan 9, included in the compressor main body 4, takes in the ventilation wind in this embodiment to cool and exhaust the inside of the main body. The after cooler 6, arranged at the exhaust port of the cooling wind, cools the high-temperature compressed air compressed by the compressor.

Each compressor unit 1 cools air as described above. Because there is a plurality of compressor units 1 in the cabinet in this embodiment, the cooling wind must be circulated efficiently so that the cooling wind of the compressor units does not collide. The cooling of the inside of the cabinet in this embodiment is described with reference to FIGS. 5 and 6.

Figure 5:
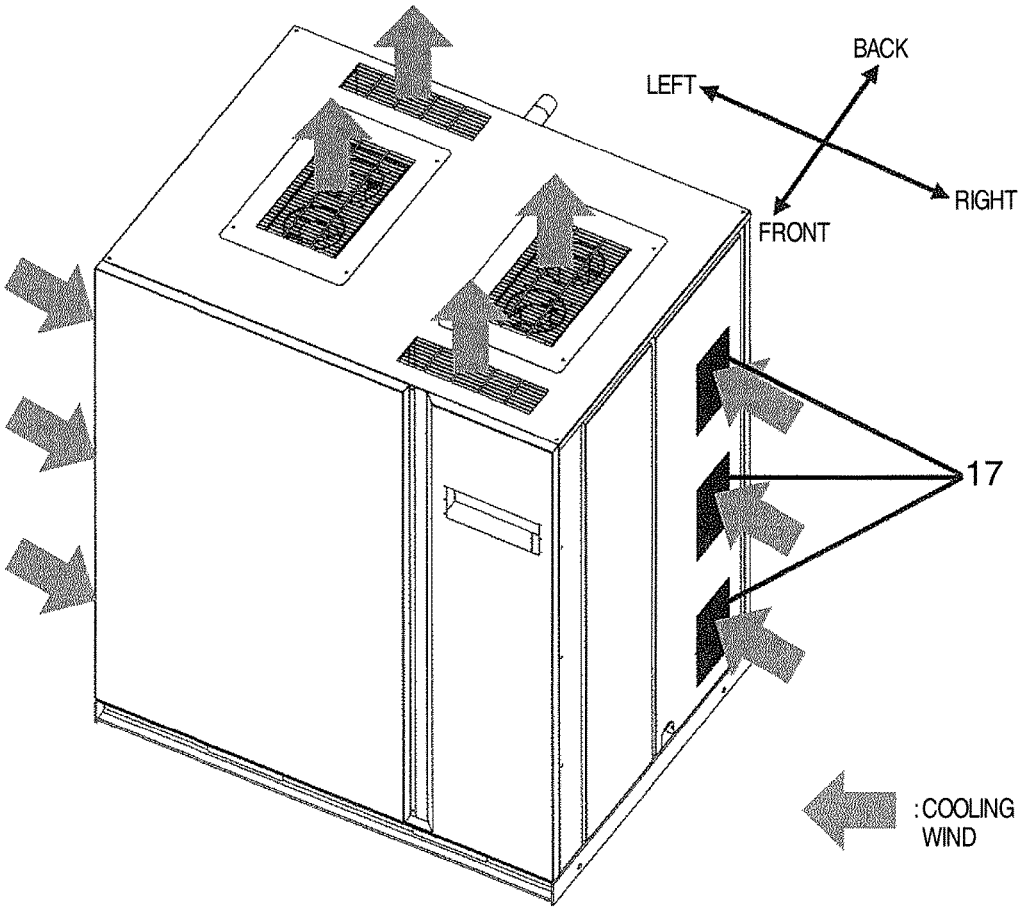
FIG. 5 is a diagram showing the flow of air in the cabinet of the package type compressor in the first embodiment of the present invention.

When the compressor units 1 are arranged opposed to each other (left and right), intake ports 17 are provided on the left and right sides and a main exhaust port is provided on the top plate, arranged above the compressor units 1, as shown in FIG. 5. That is, the cabinet is ventilated in this embodiment by taking in the air from the left and right and then exhausted from the top.

Figure 6:
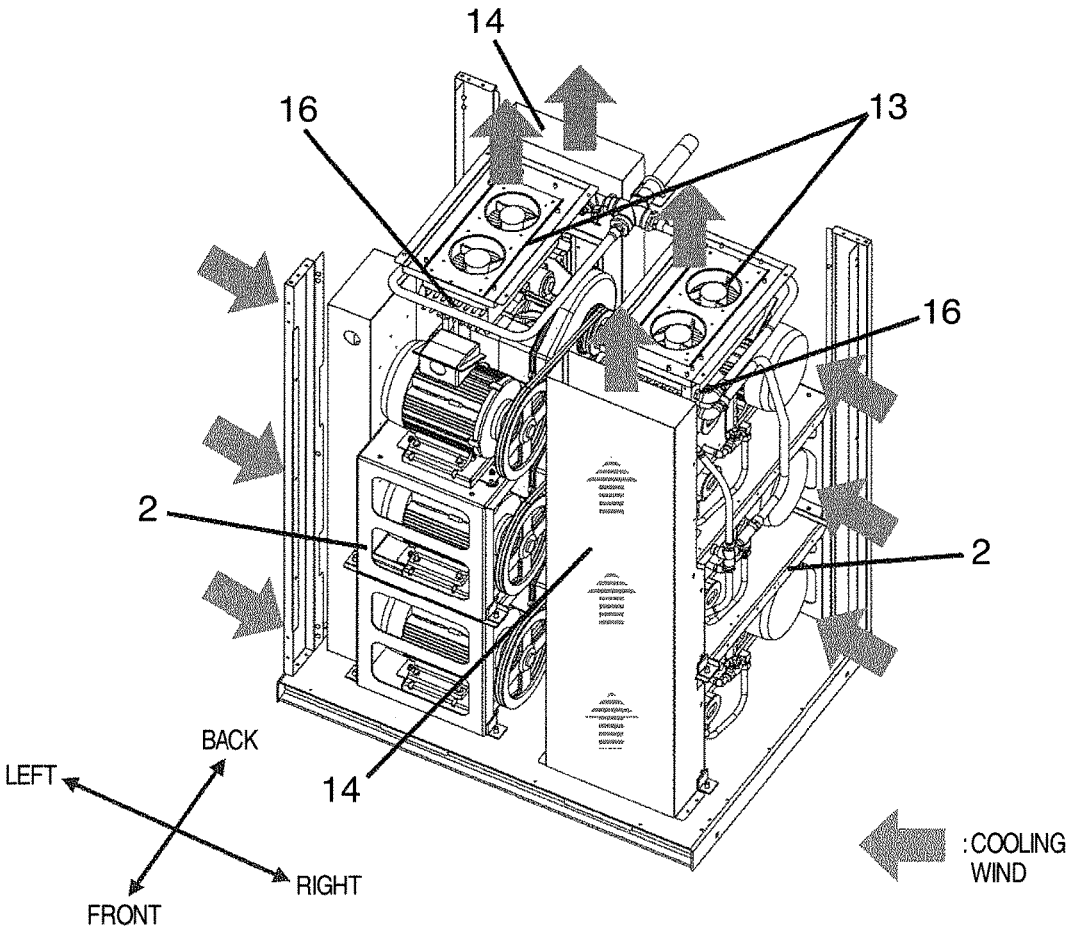
FIG. 6 is a diagram showing the flow of air in the cabinet of the package type compressor in the first embodiment of the present invention.

As shown in FIG. 6, the compressor main body 4 of one of the compressor units 2 of a pair of the opposed compressor units is arranged faced with the motor 5 of the other compressor unit in this embodiment. The intake port 17 is provided in the parts each of which is on the left or right side of the cabinet and is faced with the motors 5. Because the intake ports 17 on the left and right sides are shifted to each other in the front and back directions, this structure prevents the air, taken in from the intake ports 17, from being collided and cools each compressor unit 1, thus increasing the cooling efficiency.

Note that the sirocco fan 9 is provided in the compressor main body 4 in this embodiment. Because the sirocco fan 9 can take in the cooling wind, the cooling wind can be supplied to the compressor main body 4 even if the compressor main body 4 is arranged in a position farther away from the intake port 17 than the motor 5. On the other hand, because the sirocco fan 9 is not provided in the motor 5, a sufficient cooling wind may not be supplied to the motor 5 if the motor 5 is arranged in a position farther away from the intake port 17 than the compressor main body 4. Therefore, the intake port 17 is provided on the side opposed to the motor 5 in the cabinet in this embodiment to allow the cooling wind to be circulated in the order of motor 5, compressor main body 4, and after cooler 6. Providing the intake port in this way prevents the cooling wind inside the compressor unit 1 and the cabinet from becoming stagnant.

Although the intake ports 17 are provided on the left and right sides in this embodiment, the intake ports 17 may also be provided in the front-back positions so that air is taken in from the front and back and then exhausted from the top if the air taken-in from the intake ports 17 does not collide. That is, if the position of the intake ports 17 on one side on which the intake ports 17 are arranged is different from the corresponding position on the opposite side, the air may be taken in either from front and back or from left and right. If air taken in from the intake ports 17 does not collide, a combination of intake from front and right sides or from left and back may also be used or the intake ports 17 may be provided on the four sides (front, back, left, and right).

As shown in FIG. 6, the exhaust of the compressor unit 1 is collected into an exhaust duct 14 provided in the cabinet, and the collected exhaust is exhausted into an exhaust-duct exhaust port provided above. The exhaust-duct exhaust port is provided separately from the main exhaust port that is provided on the top of the compressor unit 1. This structure causes the cooling wind, which has cooled the compressor units 1 provided in the lower part of the stacking unit 2 and the temperature of which has increased, to flow into the exhaust duct 14. Therefore, this structure prevents the cooling wind, which has cooled the compressor units 1 in the lower part and the temperature of which has increased, from being mixed with the cooling wind for cooling the compressor units 1 in the upper part, thus preventing the temperature of the cooling wind for cooling the compressor units 1 in the upper part from being increased. As a result, the compressor units 1 in the upper part can be cooled efficiently.

As described above, a plurality of compressor units 1 is arranged opposed to each other with the belts 8 facing inward in this embodiment. This structure makes the distance between a pair of compressor units 1 smaller, reduces the total installation area of the product, and reduces the total size of the product.

In this embodiment, the main exhaust port is provided above a pair of stacking units 2 arranged opposed to each other, one for each stacking unit 2. In addition, the positions of the two intake ports 17 arranged on the left and right sides are shifted in the front and back directions. This structure prevents the air, taken in from the intake ports 17, from colliding and makes the ventilation path in the cabinet independent of each other, thus increasing the cooling efficiency. Because partitioning for configuring the ventilation path is not required, this embodiment particularly simplifies the configuration of panel parts in the cabinet and increases the ease of assembly.

In this embodiment, both the main exhaust port and the exhaust-duct exhaust port are provided to prevent the air in the cabinet from becoming stagnant and to exhaust the heated air efficiently. In addition, an exhaust fan 13, provided on the top face of each stacking unit 2, exhausts the heated air from the inside of the cabinet. Because the heated air generated in the cabinet flows upward, arranging the exhaust fan 13 on the ceiling of the cabinet efficiently exhausts the heated air.

In this embodiment, the intake port 17 of the cabinet is positioned on the rear side of each motor, and the compressor unit 1 is cooled in the order of the motor 5, compressor main body 4, and after cooler 6. This cooling method prevents the cooling wind in the compressor unit 1 and in the inside of the cabinet from becoming stagnant.

In addition, an after cooler 16, which is provided at the bottom of the exhaust fan 13, functions also as a cooler to cool the compressed air using the exhaust wind supplied from inside the cabinet, thus simplifying the components and decreasing the number of parts.

Second Embodiment

Figure 7:
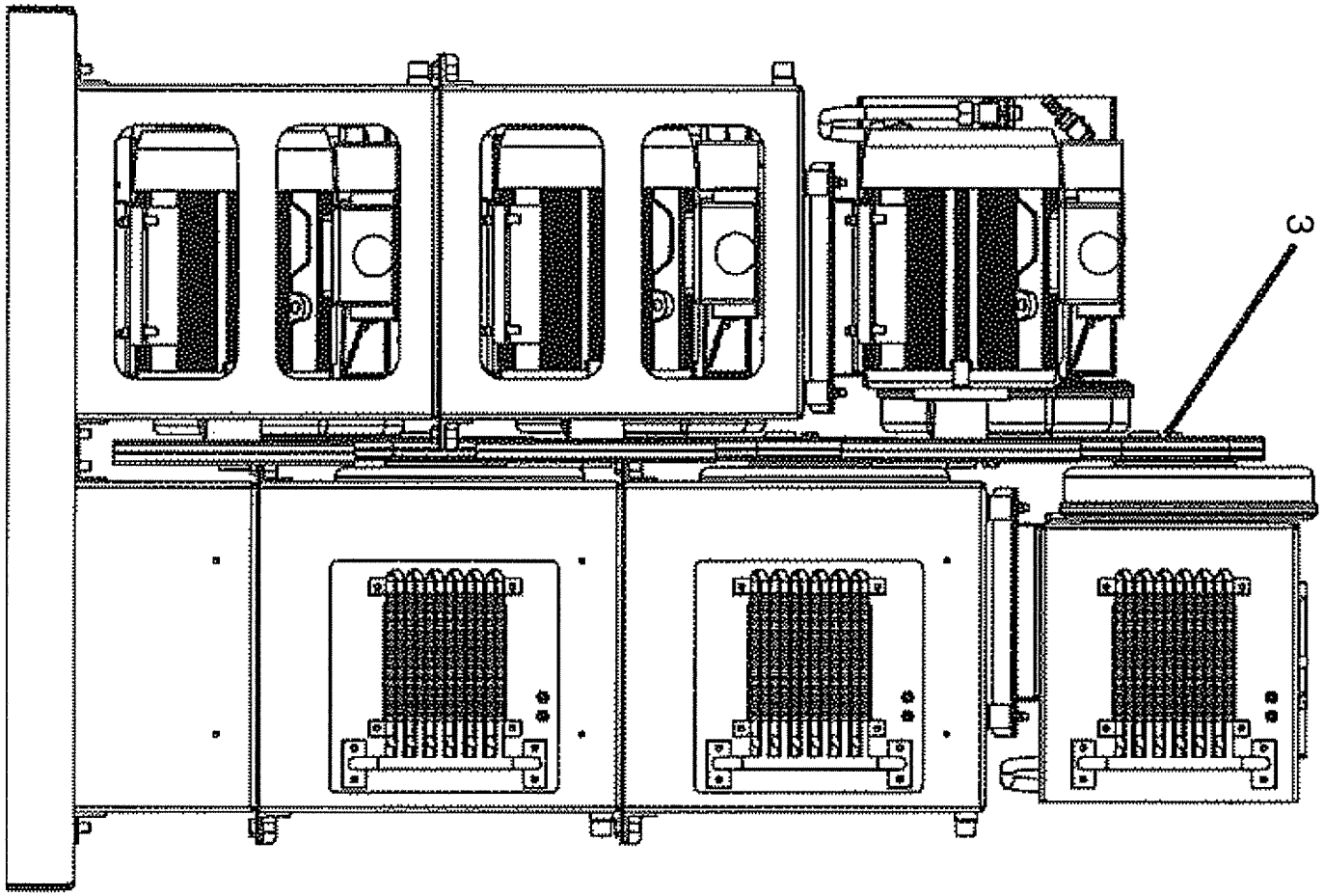
FIG. 7 is a diagram showing the structure inside the cabinet of a package type compressor in a second embodiment of the present invention.
Figure 8:
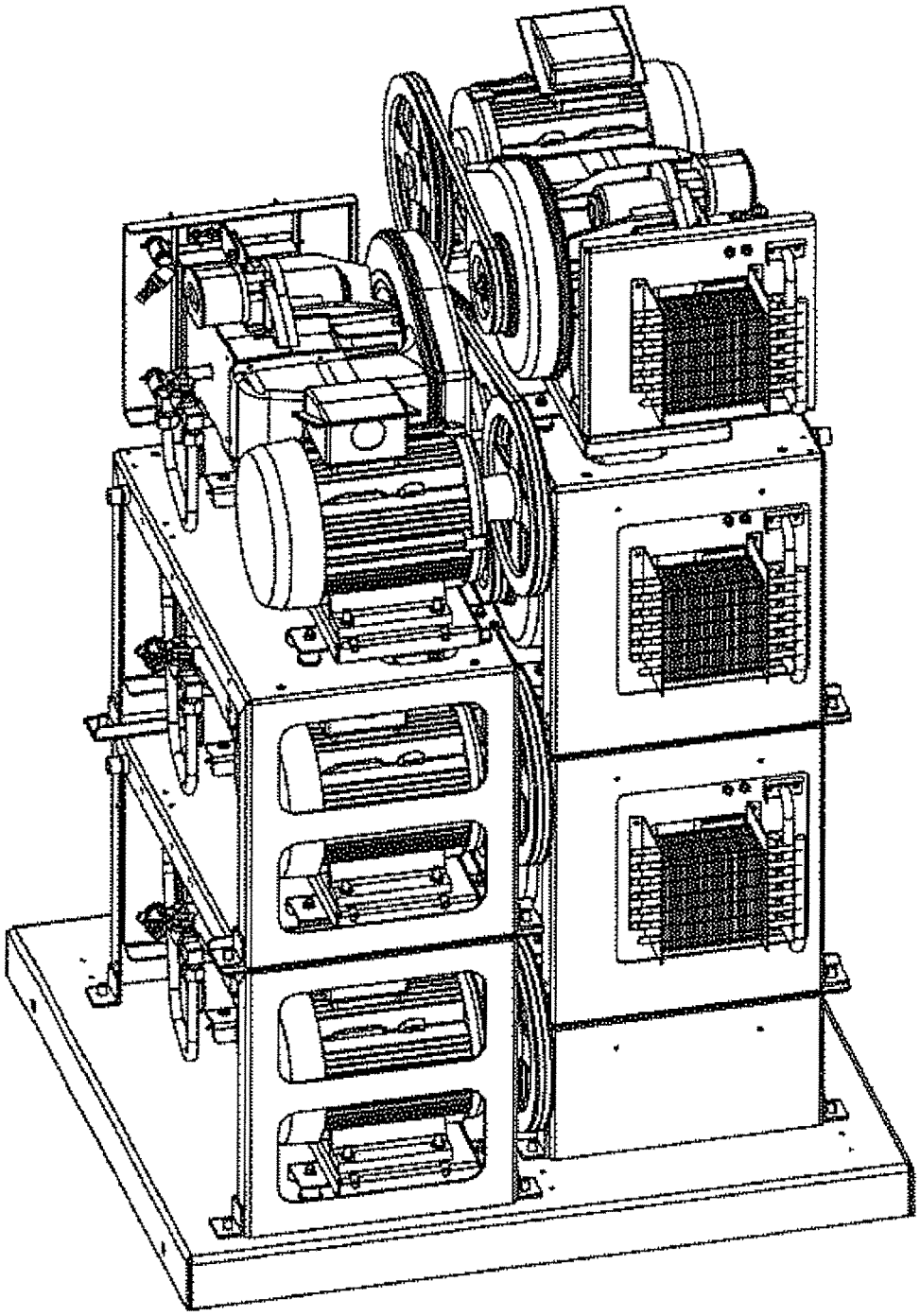
FIG. 8 is a diagram showing the structure inside the cabinet of the package type compressor in the second embodiment of the present invention.

A second embodiment of the present invention is described with reference to FIGS. 7 and 8. For the configuration similar to that in the first embodiment, the same reference numeral is given and its description is omitted.

In this embodiment, a pair of compressor units 1, arranged opposed to each other, are shifted in height so that the compressor units 1 are halfway shifted with respect to each other. That is, the pulley 3 and the belt 8 of one of the pair of compressor units 1, arranged opposed to each other, are arranged above or below the pulley 3 and belt 8 of the other compressor unit 1 in such a way that the pulleys 3 and the belts 8 of the compressor units 1 are arranged linearly. This arrangement requires less space between the units as compared with the arrangement of the first embodiment, further reducing the installation area.

Third Embodiment

Figure 9:
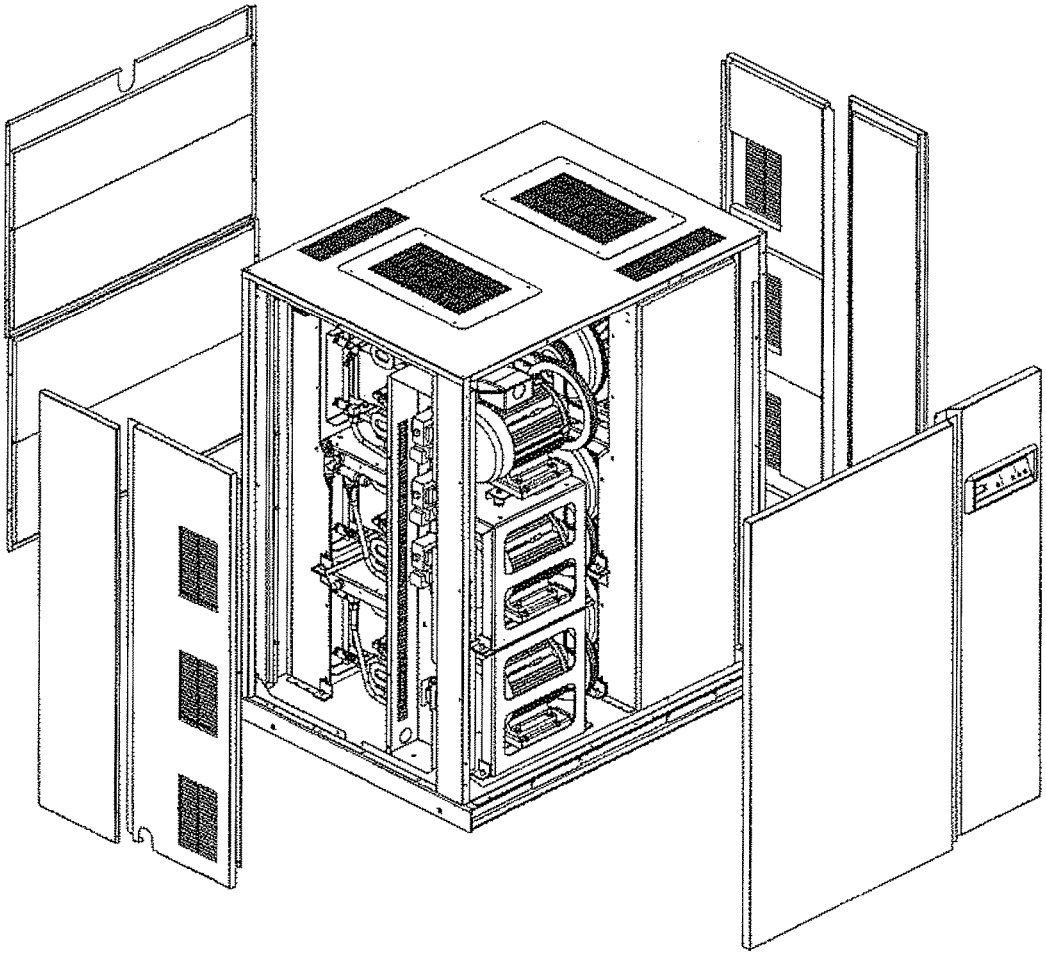
FIG. 9 is a diagram showing the structure inside the cabinet of a package type compressor in a third embodiment of the present invention.

A third embodiment of the present invention is described with reference to FIG. 9. For the configuration similar to that in the first and second embodiments, the same reference numeral is given and its description is omitted.

In this embodiment, the cabinet is configured by column-shaped panels in the four corners and the side panels attached to the column-shaped panels. This embodiment further increases the ease of assembly. In addition, the ability to completely disassemble the panel makes access to the inside of the cabinet easier at maintenance time, further increasing the maintainability.

A magnet may be used for fastening the left and right panels, opposed to the compressor main body 4 (suction filter 15) and the motor 5, without using screws. The magnet allows the panels to be removed more easily. This method makes easier the daily maintenance such as the cleaning of the suction filter 15 of the compressor main body 4 or the operation checking of the safety valve.

The embodiments described above are only examples of realizing the present invention, and the technical scope of the present invention should not be restrictively interpreted by the embodiments. That is, the present invention can be implemented in various forms without departing from the technical concept or the major characteristics thereof.

Although the present invention has been described with a scroll type compressor as an example, the present invention may be applicable also to a reciprocating compressor and a screw type compressor. In addition, the present invention may be applicable not only to a compressor but also to a fluid machine such as a vacuum pump, an expander, and a blower.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A package type fluid machine comprising:

a plurality of compressor units, each of the compressor units including:

(a) a compressor having a fixed scroll, an orbiting scroll, and a suction filter, (b) a motor that drives said compressor, and a belt that transmits power of said motor to said orbiting scroll;

said plurality of compressor units being arranged in a cabinet, said compressor units arranged in pairs opposed to each other, with, the belts of the compressor units being located at first ends of each of the compressors and arranged to face inward toward an opposed compressor, the belts positioned between the compressors of the compressor units opposite exterior side walls of the cabinet, and with each ether each of the fixed scrolls and the suction filters of the compressor units located at second ends of each of the compressors and are arranged to face outward toward the exterior side walls of the cabinet;

main exhaust ports provided in a top plate of the cabinet above the compressor units;

and a pair of intake ports provided on opposed sides of the cabinet, one for each side, said intake ports of the pair of intake ports positioned relative to each other to prevent air flows from the intake ports from colliding.

2. The package type fluid machine according to claim 1, wherein the motor of each of the compressor units in each pair is arranged opposed the compressor of that compressor unit in each pair.

3. The package type fluid machine according to claim 1, wherein said intake port is provided on a part faced with one of said motors in said cabinet.

4. The package type fluid machine according to claim 1, wherein each of said respective sides of the cabinet is defined by a side panel.

5. The package type fluid machine according to claim 4, wherein said side panel is fixed in place with a magnet.

6. The package type fluid machine according to claim 1, further comprising exhaust ducts provided inside said cabinet closer to the compressors than to the motors.

7. The package type fluid machine according to claim 1, further comprising exhaust ducts into which exhaust from the compressor units is collected, the exhaust ducts directing the collected exhaust from the compressor units into exhaust duct exhaust ports provided in the top plate between the main exhaust ports and respective sides of the cabinet separately from the main exhaust ports.

* * * * *